US005775827A

United States Patent [19]

Packham et al.

[11] Patent Number: 5,775,827

[45] Date of Patent: Jul. 7, 1998

[54] BRUSH WITH CLEANING ELEMENT

[75] Inventors: Charles Christopher Packham, Crowthorne; Robert White, Cholsey; Alan Robert Hill, Reading, all of United Kingdom

[73] Assignee: The Gillette Company, Boston, Mass.

[21] Appl. No.: 647,957

[22] PCT Filed: Nov. 29, 1994

[86] PCT No.: PCT/US94/13654

§ 371 Date: Jul. 19, 1996

§ 102(e) Date: Jul. 19, 1996

[87] PCT Pub. No.: WO96/15096

PCT Pub. Date: Jun. 8, 1995

[30] Foreign Application Priority Data

Dec. 1, 1993 [GB] United Kingdom ..... 9324686

[51] Int. Cl.[6] ..... A45D 40/00; A45D 40/26; A46B 11/00

[52] U.S. Cl. ..... 401/129; 401/122; 401/126

[58] Field of Search ..... 401/122, 129, 401/4, 121, 126

[56] References Cited

U.S. PATENT DOCUMENTS

| | | | |
|---|---|---|---|
| 3,311,941 | 4/1967 | Buchwalter et al. | 15/510 |
| 3,415,604 | 12/1968 | Ahrens et al. | 401/122 |
| 3,662,769 | 5/1972 | Vasas et al. . | |
| 3,908,675 | 9/1975 | Spatz et al. | 132/82 R |
| 4,761,088 | 8/1988 | Zubek | 401/122 |

*Primary Examiner*—Steven A. Bratlie
*Attorney, Agent, or Firm*—Chester Cekala

[57] ABSTRACT

An applicator brush (9) for a fluid contained in a container (1) is provided with means (15, 18, 20) for cleaning deposits of the dried fluid from the neck (3) of the bottle (1), thereby maintaining the neck (3) substantially free of the deposits.

20 Claims, 2 Drawing Sheets

BRUSH WITH CLEANING ELEMENT

This invention relates to liquid containers equipped with replaceable caps which carry applicator brushes used to apply the liquid contents of the container to a surface. The invention has particular relevance to correction fluid bottles.

Correction fluid bottles are commonly supplied with screw caps which also serve as handles for applicator brushes which are used to coat a substrate, e.g. paper surface, in order to obliterate an incorrect marking such as a letter or word when a correction is to be made. When an applicator brush is used, it is common practice to use the bottle neck to wipe excess correction fluid from the brush head when it is withdrawn from the bottle. As a consequence a build up of dried fluid tends to occur on the bottle neck, and in view of the quick-drying nature of the fluid this can happen quite rapidly. The accumulation of dry fluid restricts the neck opening and can lead to damage to the brush head when it is being inserted into the bottle. In addition, it can lead to unintentional wiping of fluid from the brush head and hence exacerbation of the problem. As a consequence correction fluid bottles are frequently discarded before they have been completely depleted of liquid.

The present invention addresses the above problem and as a solution provides an applicator brush for a container having a neck for insertion and removal of the brush, comprising an elongate stem carrying a brush head at a free end thereof, and including a portion spaced from the brush head and provided with cleaning means for contacting and detaching deposits collected within the neck, thereby to maintain the neck substantially free of such deposits.

In a preferred construction the brush stem portion has at least one longitudinal edge for removing deposits with a sweeping or wiping action when rotating the stem within the neck, such as when turning a cap carrying the applicator brush to screw it onto or off of the container. The edge or edges may be provided by splines or fins, or by the stem having a polygonal e.g. triangular cross section. The fins may be flexible and have an interference fit within the neck to obtain a true wiping action against the neck surface. Alternatively, the fins can be rigid and dimensioned to fit within the neck with a small clearance and hence to remove deposits with a reaming action.

A full understanding of the invention will be gained from the following detailed description of the embodiment shown in the drawings, in which.

Figure 1:
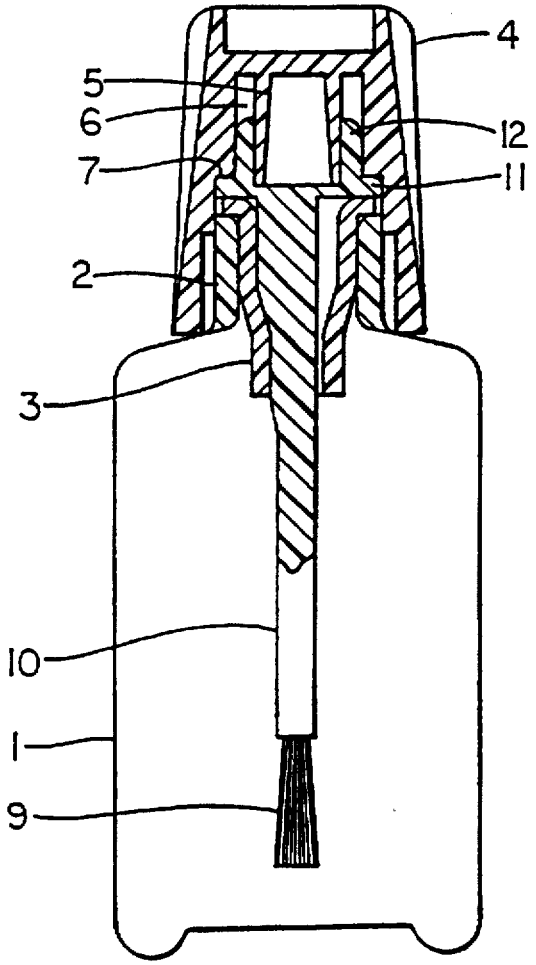
FIG. 1 shows in partial cross-section a correction fluid bottle equipped with an applicator brush in accordance with the invention.
Figure 2:
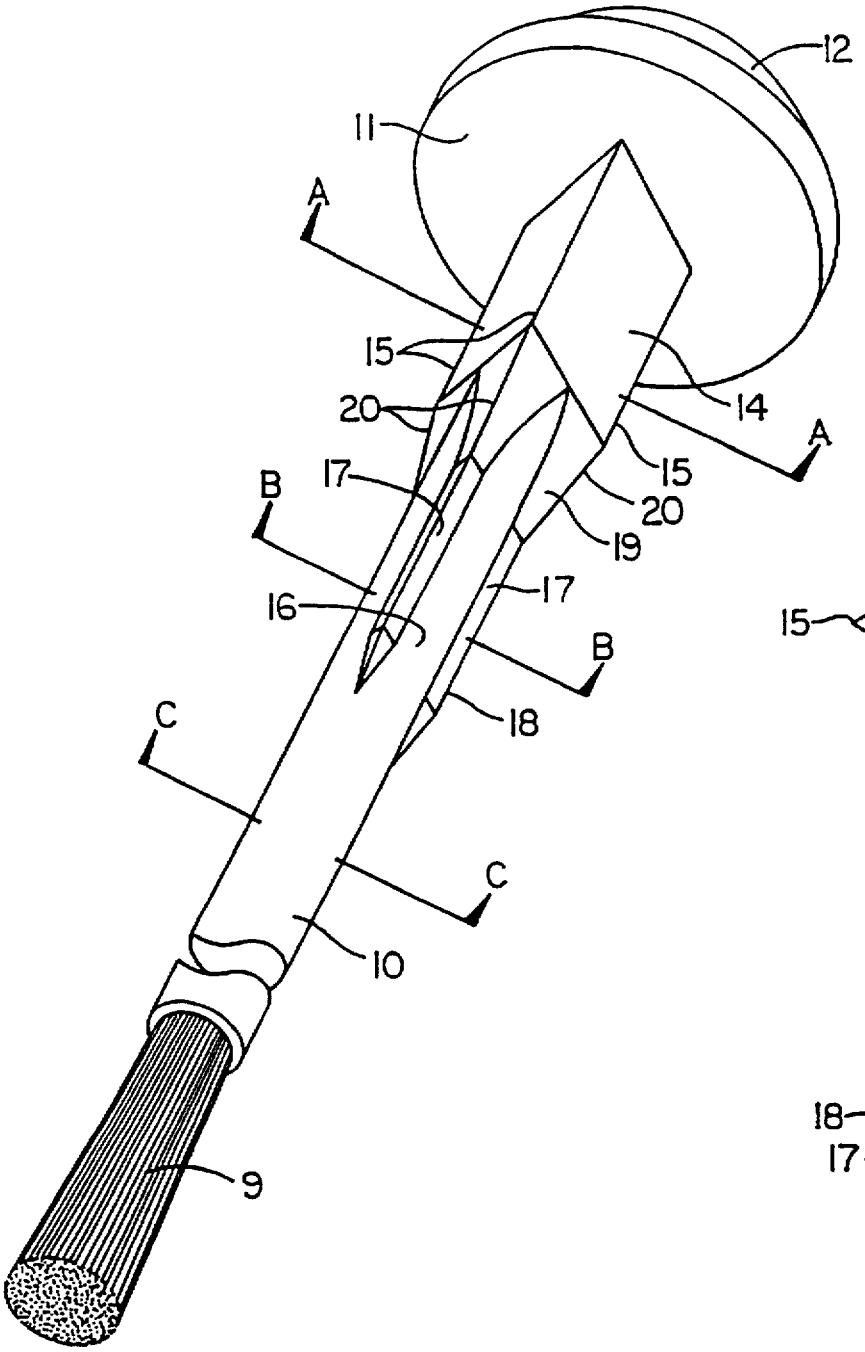
FIG. 2 is a perspective view of the applicator brush.

Apart from the applicator brush described fully below, the correction fluid bottle shown in FIG. 1 is of known construction. It has a unitary body 1 with a neck 2 into which is fitted a neck insert 3 including an upper flange defining a sealing surface, and a stepped cylindrical tube with a large diameter upper part, a tapering intermediate section and a small diameter lower part. The neck insert can serve to prevent liquid spilling if the bottle is accidentally knocked over onto its side with the cap removed.

The neck 2 of the bottle is externally screw threaded for cooperation with the cap 4 which is correspondingly internally threaded at its lower open end. The cap interior is shaped to include an axial spigot 5 defining an annular slot 6, and an axial shoulder 7 which serve to attach and locate the applicator brush.

The applicator brush has a stem 10 with a bundle of bristles 9 fixed to and defining a brush head at the free lower end of the stem. The upper end of the stem is rigidly attached to the cap 4 and for this purpose there is formed integrally with the stem a flange 11 and a hollow cylindrical projection 12 which engages with a tight friction fit in the slot 6 with the flange 11 abutting the shoulder 7. The flange defines a sealing surface for cooperation with the sealing surface of the neck insert 3 when the cap is applied tightly to the bottle as shown in FIG. 1.

Figure 3:
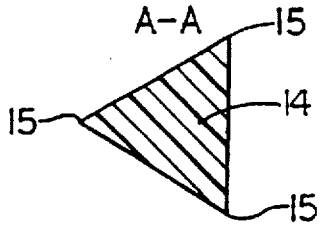
FIGS. 3, 4 and 5 are sections taken along the line A—A, B—B and C—C in FIG. 2, respectively.
Figure 4:
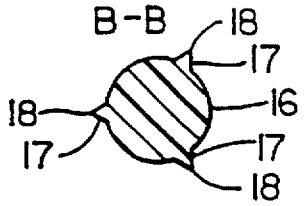
Figure 5:
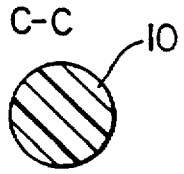

The stem portion which extends through the neck insert is formed to keep the inner surface of the neck surface clear of deposits. An upper stem section 14 has a triangular cross section (FIG. 3) defining three sharp longitudinal edges 15 which pass in contact with or at least in close proximity to the surface of the larger diameter neck part when the cap 4 is being twisted onto or off of the bottle. Another stem section 16 is formed with three equi-spaced longitudinal splines or fins 17 defining longitudinal edges 18 which slide around, or move across in close juxtaposition to the surface of the smaller diameter neck part when the cap is being twisted on or off. At an intermediate stem section 19, the fins 17 gradually change in cross-section and eventually form the corner regions of the triangular section 14, whereby radially inclined edges 20 are formed for cooperation with the tapered neck portion for removing deposits therefrom. The lower end of the stem is cylindrical. The lower ends of the fins are tapered to ease insertion of the applicator through the bottle neck.

As will be understood from the foregoing description, the action of twisting the cap 4 onto and off of the bottle neck 2 will cause the edges 15, 18, 20 to move around the inner surface of the neck and remove any deposits. The deposits may drop back into the bottle or may collect on the brush stem between the cleaning edges, where they can do no harm.

It will be appreciated the number of cleaning elements provided around the brush stem is not crucial, the important factor being that there are sufficient to sweep the entire circumference of the neck surface.

We claim:

1. A container for containing a fluid material, comprising a reservoir for storing a fluid material, the reservoir defining an internal volume for storing a fluid material, and an opening having a neck with an interior surface; and an applicator brush constructed to be removably inserted into the reservoir, the applicator brush having an elongate stem carrying a brush head at a free end thereof, the stem also including a portion spaced from the brush head and provided with a radially projecting, elongate cleaning element for contacting deposits collected within the neck of the reservoir, the elongate cleaning element arranged to sweep the entire circumference of the interior surface of the neck as the applicator brush is rotated one full revolution with respect to the reservoir.

2. A container according to claim 1, wherein the applicator brush has a screw cap for opening and closing the container, said elongate cleaning element being arranged to sweep deposits from the neck surface as the cap is screwed onto the reservoir.

3. A container according to claim 1, comprising a plurality of said radially projecting, elongate cleaning elements.

4. A container according to claim 3, wherein the stem comprises a section of polygonal cross-section defining said plurality of radially projecting, elongate cleaning elements.

5. A container according to claim 4, wherein said stem section is triangular in cross-section.

6. A container according to claim 3, wherein the elongate element is in the form of a longitudinal fin.

7. A container according to claim 6, wherein the longitudinal fin is substantially rigid.

8. A container according to claim 3, wherein the cleaning element defines a radially directed cleaning edge.

9. A container for containing a fluid material, comprising a reservoir for storing a fluid material, the reservoir defining an internal volume for storing a fluid material, and an opening having a neck with an interior surface; and an applicator brush constructed to be removably inserted into the reservoir, the applicator brush having an elongate stem carrying a brush head at a free end thereof, the stem including a plurality of radially projecting cleaning elements for contacting deposits collected within the neck, the cleaning elements circumferentially spaced from one another and arranged to scrape said collected deposits from the neck as the applicator brush is rotated within the neck.

10. A container according to claim 9, wherein the applicator brush has a screw cap for opening and closing the container, said cleaning elements being arranged to sweep deposits from the neck surface as the cap is screwed onto the reservoir.

11. A container according to claim 9, wherein the stem comprises three said radially projecting cleaning elements.

12. A container according to claim 9, wherein the cleaning elements are substantially rigid.

13. A container for containing a fluid material, comprising a reservoir for storing a fluid material, the reservoir defining an internal volume for storing a fluid material, and an opening having a neck with an interior surface; and an applicator brush constructed to be removably inserted into the reservoir, the applicator brush having an elongate stem carrying a brush head at a free end thereof, the stem including a rigid, radially projecting cleaning element arranged to scrape deposits from the neck as the applicator brush is rotated within the neck.

14. A container according to claim 13, wherein the applicator brush has a screw cap for opening and closing the container, said cleaning element being arranged to sweep deposits from the neck surface as the cap is screwed onto the reservoir.

15. A container according to claim 13, wherein the stem comprises a plurality of said cleaning elements.

16. A container according to claim 13, wherein the cleaning element comprises a longitudinal fin.

17. A container according to claim 1, 9 or 13, wherein the fluid comprises correction fluid.

18. A method of removing deposits from an interior surface of a neck of a reservoir having fluid therewithin and an associated applicator brush, the method comprising circumferentially sweeping the interior surface of the neck with a scraping element on the applicator brush to remove deposits of the fluid collected on the interior surface of the neck.

19. A method according to claim 18, wherein the applicator brush comprises a cap threadably detachable from the reservoir, the method including unthreading the cap from the reservoir, thereby circumferentially sweeping the interior surface of the neck with a scraping element on the applicator brush to remove deposits of the fluid collected on the interior surface of the neck.

20. A method according to claim 18, wherein the fluid comprises correction fluid.

* * * * *